United States Patent [19]

Borlinghaus

[11] 3,930,391

[45] Jan. 6, 1976

[54] LOCK CYLINDER COVER WITH KEY ENGAGEMENT RELEASE

[75] Inventor: Hans J. Borlinghaus, Clarkston, Mich.

[73] Assignee: General Motors Corporation, Detroit, Mich.

[22] Filed: Mar. 17, 1975

[21] Appl. No.: 558,847

[52] U.S. Cl. ..... 70/455

[51] Int. Cl.[2] ..... E05B 17/18

[58] Field of Search ..... 70/455, 55, 423; 150/52 K, 150/52 L

[56] References Cited

UNITED STATES PATENTS

| | | | |
|---|---|---|---|
| 2,213,814 | 9/1940 | Jacobi | 70/455 |
| 2,343,605 | 3/1944 | Wise | 70/455 |
| 2,400,229 | 5/1946 | Freeman | 70/455 |
| 2,454,925 | 11/1948 | Jacobi | 70/455 |
| 2,602,319 | 7/1952 | Jacobi | 70/455 |

*Primary Examiner*—Robert L. Wolfe

*Attorney, Agent, or Firm*—John P. Moran

[57] ABSTRACT

A lock cylinder cover arrangement including a spring detent secured at one end thereof to the underside of a cover base or escutcheon, wherein the spring detent has a stop surface and a cam surface formed adjacent the other end thereof, the stop surface serving to hold open a cover pivotally mounted on the escutcheon, and the cam surface serving to be cammed downwardly toward the lock cylinder by an edge of the keyhead to thereby release the stop surface from the cover and permit the latter to be biased closed upon withdrawal of the key from the lock cylinder.

3 Claims, 6 Drawing Figures

LOCK CYLINDER COVER WITH KEY ENGAGEMENT RELEASE

This invention relates generally to lock cylinder cover arrangements and, more specifically, to such arrangements which include detent means for retaining a cover in an open position and for automatically permitting the cover to return to a closed position upon withdrawal of the key from the lock cylinder.

Heretofore, the lock cylinder cover arrangements used on vehicular trunk lids for shielding the locks from inclement weather conditions have generally included some type of projection formed on the exposed end surface of the lock cylinder assembly. An example of the latter arrangement is shown and described in Jacobi U.S. Pat. No. 2,213,814.

While such arrangements are generally satisfactory in operation, it is an object of the invention to provide an improved lock cylinder cover arrangement which eliminates the necessity of forming cams on the lock cylinder per se and, in lieu thereof, to provide a simplified, efficient spring detent means secured to the cover base or escutcheon.

Another object of the invention is to provide such an improved spring detent-type lock cylinder cover arrangement which is readily operable with one hand through the steps of manually opening the cover, inserting and rotating the key to unlock the lock mechanism, and having the cover automatically close upon withdrawal of the key.

A further object of the invention is to provide an improved spring detent means which may be readily secured to the underside of a typical escutcheon, and including both a stop surface for retaining the cover in an open position and a cam surface engageable by the head of a key during the unlocking operation, causing the stop surface to be released from an edge of the cover and thus permitting the cover to close upon withdrawal of the key from the lock cylinder.

Figure 1:
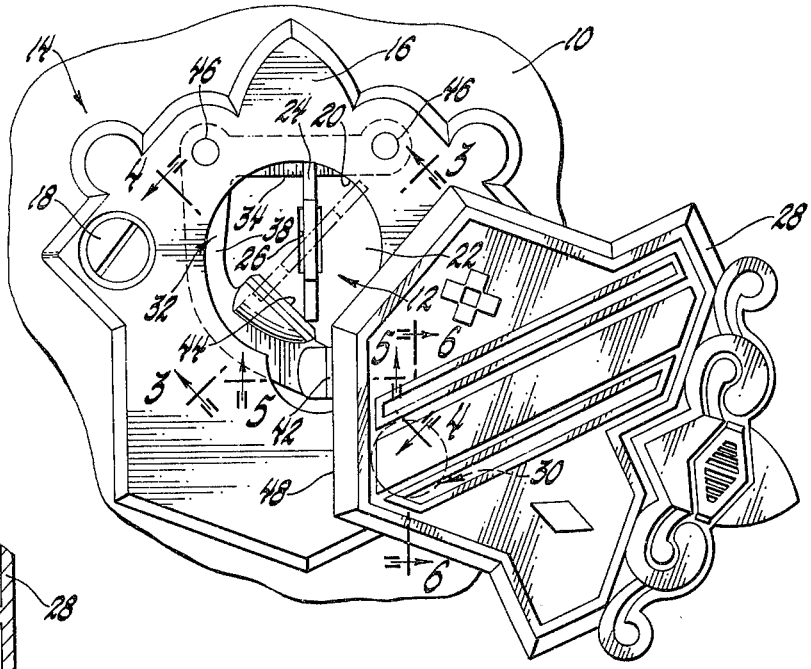
Figure 2:
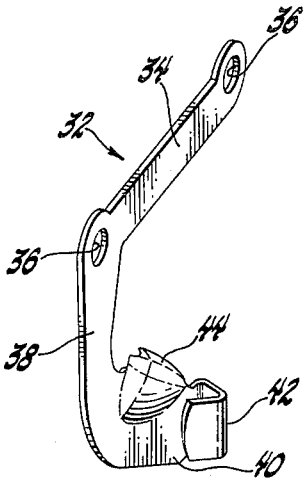
Figure 4:
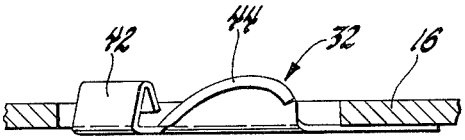

These and other objects and advantages of the invention will be apparent when reference is made to the following description and accompanying drawings, wherein:

FIG. 1 is a fragmentary plan view of a vehicular trunk lid embodying the inventive lock cylinder cover arrangement;

FIG. 2 is a perspective view of one of the elements of the FIG. 1 structure; and FIGS. 3, 4, 5, and 6 are fragmentary cross-sectional views taken along the planes of the respective lines 3—3, 4—4, 5—5, and 6—6 of FIG. 1, and looking in the directions of the respective arrows.

Referring to the drawings in greater detail, FIG. 1 illustrates a vehicular trunk lid 10 including a conventional lock cylinder assembly 12 having a lock cylinder cover arrangement 14 associated therewith.

The lock cylinder cover arrangement 14 includes a cover base or escutcheon 16 secured by suitable fasteners 18 to the trunk lid 10 and having a central opening 20 formed therein for exposing an end surface 22 of the lock cylinder assembly 12. A key 24 is manually inserted in the inlet opening 26 formed in the lock cylinder end surface 22, the key 24 being inserted therein through the opening 20 of the escutcheon 16 when a cover member 28 is pivoted away from the opening 20 (FIG. 1) about a conventional spring-loaded, pivotal support arrangement 30 operatively connected between the escutcheon 16 and the cover member 28.

A spring detent 32, shown individually in FIG. 2 and in operating location in FIG. 1, includes a support arm 34 having apertures 36 formed in opposite ends thereof, and a resilient arm having a spring member 38 extending from one end of the support arm 34 substantially perpendicular thereto and an operating member 40 formed on the free end of the spring member 38. A bent end-portion 42 is formed on the free end of the operating member 40, serving as a stop surface for a purpose to be described later. A contoured extension 44 is formed along an edge of the operating member 40 intermediate the bent-end portion 42 and the spring member 38, serving as a cam surface, as will be discussed later. As illustrated in FIG. 1, the spring detent 32 is secured to the underside of the escutcheon 16 by mounting the apertures 36 thereof onto respective studs 46 formed on the escutcheon 16, the studs 46 being swaged or otherwise deformed around the outer edges of the apertures 36, after the spring detent 32 is mounted, securing the support arm 34 substantially tangent to an upper edge of the opening 20, as shown in FIG. 1.

Figure 5:
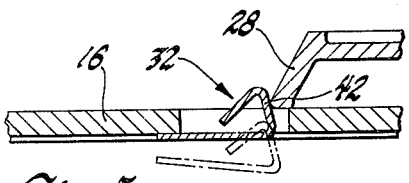

As illustrated in FIGS. 1 and 5, when the cover member 28 is initially pivoted about the pivotal support means 30, prior to insertion of the key 24 into the cylinder of the lock cylinder assembly 12, the bent end-portion or stop surface 42 is depressed toward the end surface 22 of the lock cylinder assembly 12 until such time as a predetermined edge 48 of the cover member 28 snaps past the stop surface 42, permitting the surface 42 to spring back to the position shown in FIG. 5, thus serving to retain the cover member 28 in the fully-open position shown in FIG. 1.

Figure 3:
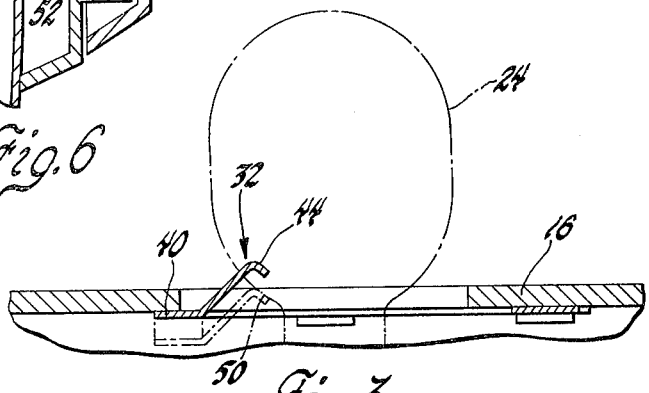

After manual insertion of the key 24 into the inlet opening 26 of the lock cylinder assembly 12, any unlocking rotational movement of the key 24 in a clockwise direction, as seen in FIG. 1, serves to abut an arcuate edge 50 (FIG. 3) of the head of the key 24 against the cam surface 44 of the spring detent 32. Once the key 24 has been rotated a predetermined amount, say 45°, the surface 50 thereof will have moved across the length of the cam surface 44, depressing the operating member 40 of the spring detent 32 toward the end surface 22 of the lock cylinder assembly 12, as illustrated in FIG. 3, such that the interrelated stop surface 42 (FIG. 4) will have been moved away from the edge 48 of the cover member 28, as illustrated in FIG. 5, permitting a torsion spring 52 (FIG. 6) of the pivotal support arrangement 30 to bias the cover member 28 in a counterclockwise direction, as seen in FIG. 1, into contact with the key 24. Thus, when the key 24 is withdrawn from the lock cylinder assembly 12, the cover member 28 will be urged by the spring 52 back to its original or closed position in vertical alignment with the escutcheon 16.

Figure 6:
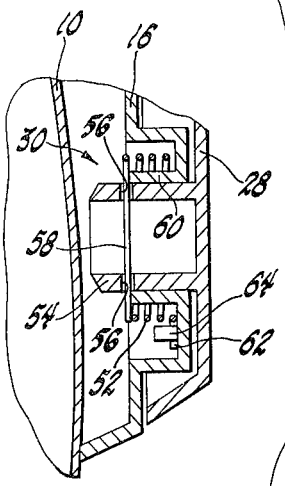

It may be noted in FIG. 6 that the conventional spring-loaded pivotal support arrangement 30 typically includes a cylindrical extension 54 formed on the undersurface of the cover member 28, with aligned openings 56 formed through oppositely disposed wall portions thereof. A straight end-portion 58 formed on one end of the torsion spring 52 extends through the aligned openings 56 and serves to retain the cover member 28 on the escutcheon 16 by abutting against the end of a cylindrical extension 60 mounted concentrically around the cylindrical extension 54. The torsion spring 52 is mounted around the cylindrical extension 60, with a hook-portion 62 formed on the other end thereof for retention around a lug 64 formed on the escutcheon 16, the torsion spring 52 thus serving to both retain the cover member 28 on the escutcheon 16 and to urge the cover member 28 toward a closed position.

It should be apparent that the lock cylinder cover arrangement of the invention provides a simplified and efficient means for permitting a lock cylinder cover member to be rotated away from the lock cylinder key inlet opening, while effectively retaining same in such open position until the key is inserted into the inlet opening and rotated through the unlocking operation, with the head of the rotating key engaging a cam surface and, thereby, releasing the cover member from a stop surface for automatic return to its originally closed position upon withdrawal of the key from the lock cylinder, all of which may be accomplished by the operator with one hand.

It should be further apparent that while a clockwise operational direction has been shown and described, the lock cylinder, spring detent and cover member could each be constructed to operate as well in the counterclockwise direction.

While but one embodiment of the invention has been shown and described, other modifications thereof are possible.

I claim:

1. For use with a vehicle body trunk lid including a lock cylinder mounted thereon with an outwardly facing key opening for receiving a key to permit rotation thereof through an unlocking operation of said lock cylinder, a cover arrangement comprising an escutcheon secured to said trunk lid and having a central opening formed therein axially aligned with said lock cylinder, a cover member pivotally mounted on said escutcheon for movement between a closed position covering said opening and an open position permitting access through said opening to said key opening, resilient means operatively connected between said cover member and said escutcheon for urging said cover member toward said closed position, and a spring detent secured to the underside of said escutcheon and including a resilient arm having a stopping surface and an adjacent camming surface formed thereon and extending outwardly through said opening in said escutcheon, said stopping surface serving to normally abut against an edge of said cover member to retain said cover member in said open position, and said camming surface adapted to being deflected toward said lock cylinder by said key upon rotation thereof through said unlocking operation to, thereby, withdraw said stopping surface from said cover member, permitting said resilient means to move said cover member back to its closed position upon removal of said key from said lock cylinder.

2. For use with a vehicle body trunk lid including a lock cylinder mounted thereon with an outwardly facing key inlet opening for receiving a key to permit rotation thereof through an unlocking operation of said lock cylinder, a cover arrangement comprising an escutcheon secured to said trunk lid and having a central opening formed therein axially aligned with said lock cylinder, a cover member pivotally mounted on said escutcheon for movement between a closed position covering said central opening and an open position permitting access through said central opening to said key inlet opening, resilient means operatively connected between said cover member and said escutcheon for urging said cover member toward said closed position, and a spring detent including a support arm secured to the underside of said escutcheon, a spring arm extending from one end of said support arm, and an operating arm extending from the free end of said spring arm, a stop surface and an adjacent cam surface formed on said operating arm and extending outwardly through said opening in said escutcheon, said stop surface serving to normally abut against an edge of said cover member to retain said cover member in said open position, and said cam surface adapted to being deflected toward said lock cylinder by an edge of the exposed head of said key upon being manually rotated through said unlocking operation to, thereby, release said stop surface from said edge of said cover member, permitting said resilient means to move said cover member back to its closed position upon removal of said key from said lock cylinder.

3. For use with a vehicle body trunk lid including a lock cylinder mounted thereon with an outwardly facing key inlet opening for receiving a key to permit rotation thereof through an unlocking operation of said lock cylinder, a cover arrangement comprising an escutcheon secured to said trunk lid and having a central opening formed therein axially aligned with said lock cylinder, a cover member pivotally mounted on said escutcheon for movement between a closed position covering said central opening and an open position permitting access through said central opening to said key inlet opening, resilient means operatively connected between said cover member and said escutcheon for urging said cover member toward said closed position, and a spring detent including a support arm secured to the underside of said escutcheon, a spring arm extending from one end of said support arm, and an operating arm extending from the free end of said spring arm, a bent-end-portion formed on the free end of said operating arm and providing a stop surface, and a bowed extension formed on an edge of said operating arm intermediate said bent end-portion and said spring arm and providing a cam surface, said stop surface and said cam surface extending outwardly through said opening in said escutcheon, said stop surface serving to normally abut against an edge of said cover member to retain said cover member in said open position, and said cam surface adapted to being deflected toward said lock cylinder by an arcuate-shaped edge of the head of said key upon manual rotation thereof through said unlocking operation to, thereby, release said stop surface from said edge of said cover member and thus permit said resilient means to move said cover member back to its closed position upon removal of said key from said lock cylinder.

* * * * *